US005713817A

United States Patent [19]

Buchanan

[11] Patent Number: 5,713,817

[45] Date of Patent: Feb. 3, 1998

[54] SHOCK DISPLACING INFLATABLE BAG

[76] Inventor: David D. Buchanan, R-1, Box 1784, Seymour, Mo. 65746

[21] Appl. No.: 199,391

[22] Filed: Feb. 22, 1994

[51] Int. Cl.[6] ..... A63B 69/00

[52] U.S. Cl. ..... 482/23; 482/148; 5/453

[58] Field of Search ..... 482/23; 5/644, 5/454, 449, 455, 453, 914, 632, 921; 182/137; 441/41; 128/DIG. 15; 602/13

[56] References Cited

U.S. PATENT DOCUMENTS

| | | | |
|---|---|---|---|
| 1,383,831 | 6/1921 | Hilker | 5/449 |
| 2,574,046 | 11/1951 | Logan . | |
| 3,251,075 | 5/1966 | Saltness et al. . | |
| 3,283,343 | 11/1966 | Worcester . | |
| 3,426,891 | 2/1969 | Marks . | |
| 3,638,253 | 2/1972 | Stumpf . | |
| 4,038,712 | 8/1977 | Miller | 5/371 |
| 4,287,250 | 9/1981 | Rudy . | |
| 4,357,724 | 11/1982 | Laforest | 5/449 |
| 4,405,129 | 9/1983 | Stuckey . | |
| 4,462,510 | 7/1984 | Steer et al. | 222/48 |
| 4,723,329 | 2/1988 | Vaccaro . | |

*Primary Examiner*—Jerome Donnelly
*Attorney, Agent, or Firm*—Gregory W. Osterloth

[57] ABSTRACT

A shock-displacing inflatable bag for use in balance games, recreation or exercise comprises a bag constructed of material that does not stretch or otherwise absorb shock. The bag is formed from a single sheet of material which is first joined at a set of opposite edges using a lap seam. The lap seam allows the bag to roll from side to side without restriction. The two open ends of the bag are then joined using sandwich seams. A valve is then mounted over a hole in the bag for purposes of inflation and deflation. Radio frequency heat sealing provides a method for creating strong, permanent seams which can withstand forces imparted to the bag. Denser vinyl coated, woven fabrics provide the best resistance to shock and stretch.

8 Claims, 2 Drawing Sheets

FIG. 1
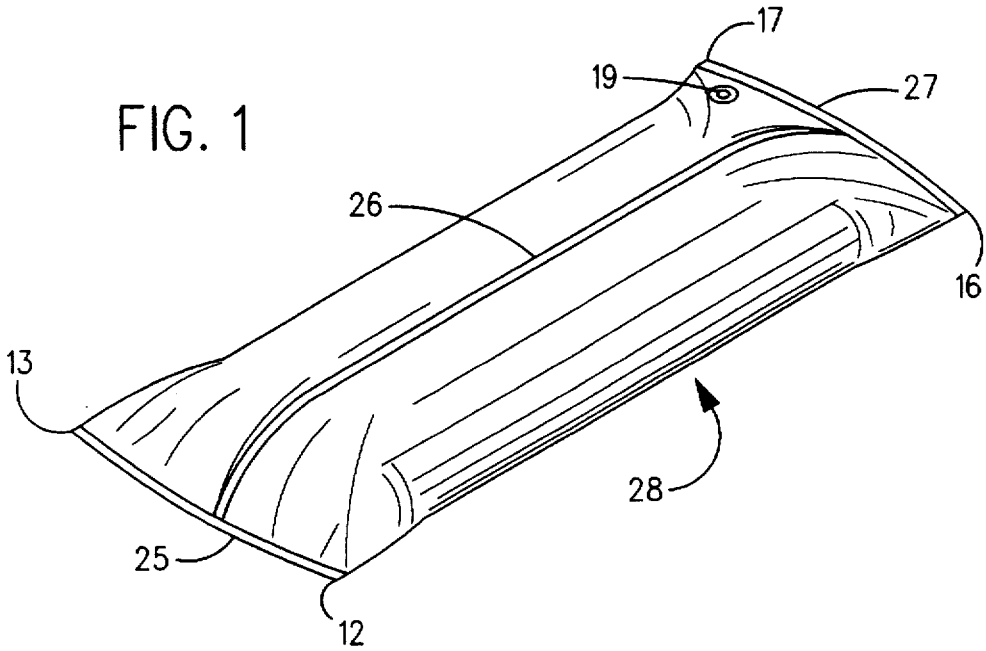
FIG. 2
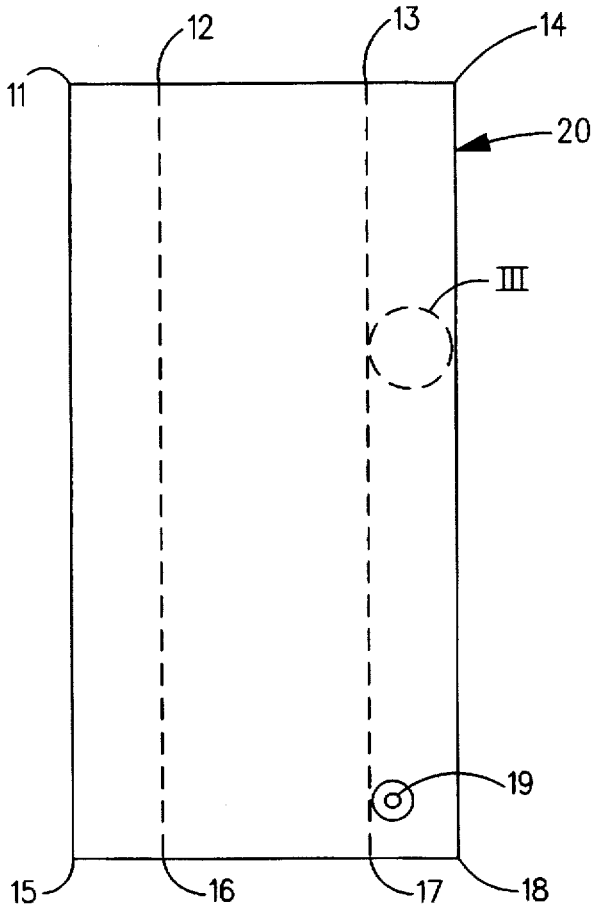
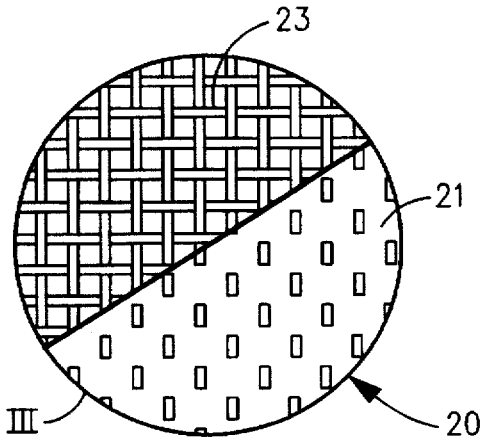
FIG. 3

FIG. 4
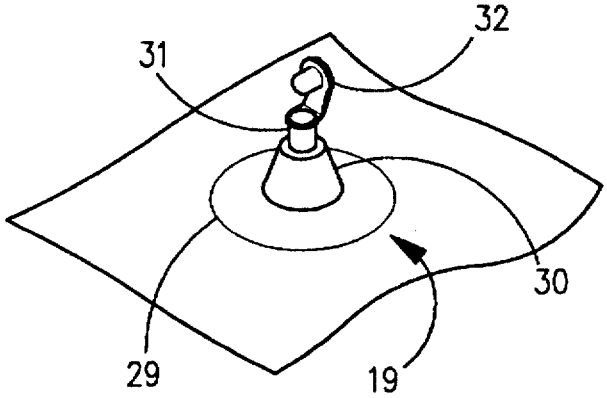
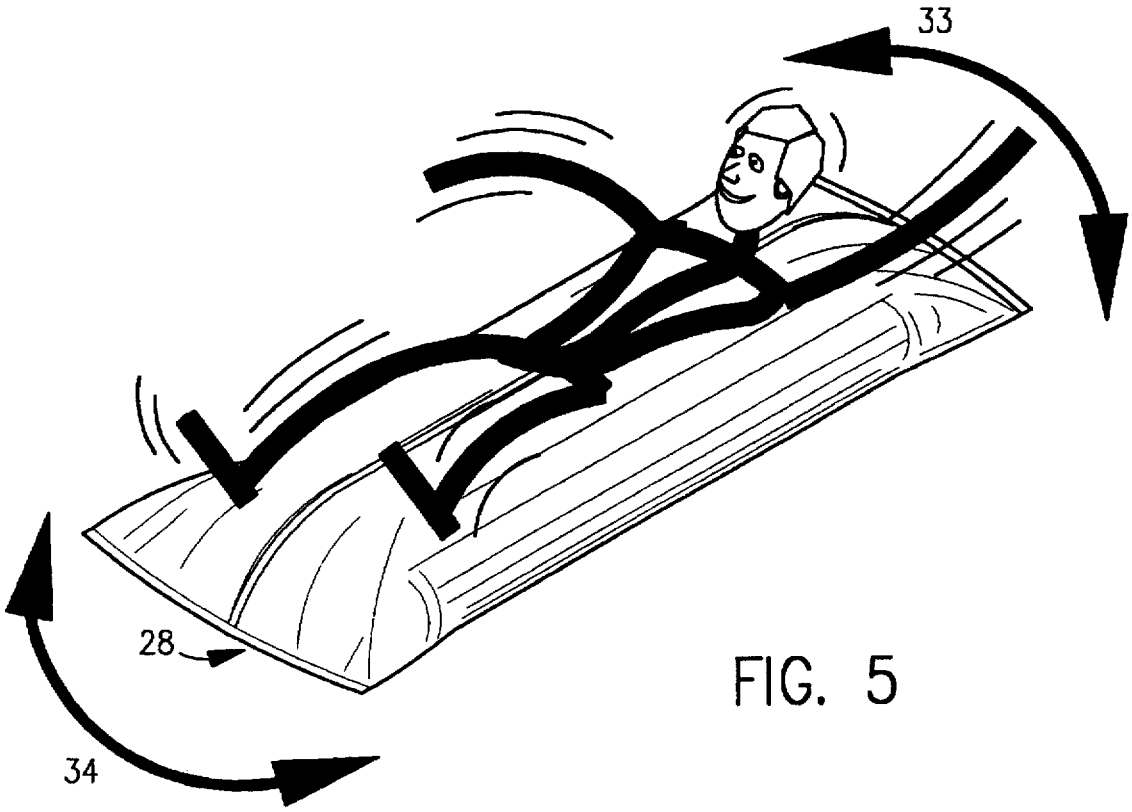
FIG. 5

SHOCK DISPLACING INFLATABLE BAG

BACKGROUND

This invention pertains to a shock displacing inflatable bag which may be used in balance games, or for recreational or exercise purposes.

Many forms of inflatable pillows and devices have been invented in the past, but these prior inventions have strived for increased comfort, support and cushioning. Improved shock absorption and resiliency are common features of these inventions.

Thus, it was the goal of the inventor to design an inflatable bag which could be used in balancing games, and in recreation or exercise, which would not absorb shock, but merely displace it.

SUMMARY

The present invention is directed to a device that satisfies this need for a shock displacing inflatable bag.

The invented device is a shock displacing bag comprising a flexible rectangular sheet of material, incapable of stretching or absorbing shock, joined at one set of opposite edges by a lap seam so as to form a cylindrical body with two ends. The ends of the cylinder are closed with sandwich seams, and a valve is mounted to the bag for purposes of inflation and deflation. Radio frequency heat sealing provides the best technique for sealing the seams and mounting the valve. The completed bag should have dimensions slightly larger than its user. To this end, the inventor has found that a bag seven feet long and three feet wide will accommodate most users.

In use, the bag is filled approximately three-quarters full with air. Underfilling the bag will allow a user to lie on the bag, and overfilling will remove the deceptive nature of the bag.

In one balance game, a user will try to lie on the bag and balance their weight thereon. The construction of the bag makes it nearly impossible for the user to remain in a stationary position. After a short time (usually no more than a couple of seconds), the bag will shift or roll, causing the user to fall to the floor.

In another balance game, two participants sit on opposite ends of the bag and try to throw or roll the other from the bag. The difficulty lies in the fact that any shock movement (a bounce, etc.) imparted by one user will not only be displaced to the other user, but will also return as a jolt to the original instigator.

In addition to being used as a game, the inventor can foresee the bag being used for exercise purposes, such as stomach toning and blocking practice.

It is, therefore, a primary object of the present invention to provide a shock displacing inflatable bag which may be used in balance games involving one or more participants.

In the achievement of the foregoing object, it is a very important object of the present invention to provide an inflatable bag which is constructed of material that does not stretch.

It is also an important object of this invention to provide a shock displacing bag which is constructed of material that is strong enough to withstand violent forces and tearing, yet is flexible enough for inflation.

It is a further object of this invention to provide a method of permanently joining the seams of the bag such that the bag will be able to roll in at least one direction.

It is yet another object of this invention to provide a bag which appears as if it has the size and stability to comfortably support its users, but when mounted by one or more users, does not provide any support whatsoever.

Another important object of this invention is to provide a shock displacing inflatable bag which may be used as a practice aid for contact sports, whereby the bag is placed between two opponents, and each feels the force generated by the other, without actual contact occurring.

It is also a very important object of this invention to provide an inflatable bag which is constructed using a minimum number of parts and manufacturing steps, thereby reducing its manufacturing cost.

BRIEF DESCRIPTION OF THE DRAWINGS

These and other features, aspects and advantages of the present invention will become better understood with regard to the following description, appended claims and accompanying drawings where:

FIG. 1 is a perspective view, on a reduced scale, showing an inflated version of the invention.

FIG. 2 is a plan view showing the materials of construction of the invention in FIG. 1, prior to their formation into an inflatable bag.

FIG. 3 is an exploded view showing the makeup of the material used in FIG. 2, part being broken away to reveal details of construction.

FIG. 4 is an exploded perspective view of a valve which may be used in the invention of FIG. 1.

FIG. 5 is a perspective view showing the invention of FIG. 1 in use.

DESCRIPTION OF THE PREFERRED EMBODIMENT

An inflatable bag embodying the principles of this invention is broadly designated in FIG. 1 of the drawings by the reference numeral 28. The bag 28 is preferably constructed from an initially flat sheet of material 20. The dimensions of the sheet 20 are preferably six feet wide (from point 11 to point 14 in FIG. 2) by seven feet long (from point 11 to point 15 in FIG. 2). However, dimensions ranging from four feet to eight feet wide, and from two feet to eight feet long have been found to be useful. A hole is cut in the material for subsequent placement of a valve 19.

The material 20 must be extremely strong and inelastic. It should be capable of receiving heavy blows without ripping or tearing, yet it must also receive such blows without stretching or yielding to them. The material which the inventor has found to work best is a nineteen ounce, vinyl coated, 17×17 polyester scrim 21. See FIG. 3. Vinyl laminated material is a possible substitute for vinyl coated material, however, the coated material is preferred as it is more conducive to heat sealing since the vinyl completely surrounds and penetrates the fibers of the base material. Other industrial fabrics, namely nylon, can be used as a base material. Woven threads 23 seems to be the most important factor in choosing a base material. A knitted base fabric allows for too much stretch. Similarly, a pure vinyl also has a certain amount of elasticity (and does not provide enough protection against tearing). While a 17×17 scrim seems to give an ideal balance between strength, rigidity and cost, other weave densities will suffice. Those of higher density are desirable, but add additional cost to the bag. Those with a density between 9×9 scrim and 17×17 scrim will work, but with increasingly less favorable results as the weave density is decreased. Those materials having a weave density of less than 9×9 are found to be undesirable.

The bag 28 is constructed by joining edges 11–15 and 14–18 (FIG. 2) so as to form a 1" center lap seam. Additionally, a valve 19 is secured over the hole cut in the bag's material 20. Subsequently, the ends of the bag, 12–13 and 16–17 (FIG. 1), are joined with a 1" sandwich seam. The finished bag will thus have a center seam 26 which perpendicularly intersects the two end seams 25 and 27. The center lap seam is required so that the inflated bag can roll from side to side (FIG. 5). A sandwich seam would interfere with the bags rolling movement. Other methods of securing the end seams are possible, but a sandwich seam appears to be most effective.

The bag's seams are best secured with the aid of a radio frequency heat sealer (RF heat sealer). The valve 19 is also best secured with an RF heat sealer (the valve must be of a heat sealable type). An RF heat sealer operating temperature of between 270–280 degrees Fahrenheit seems to be most effective in creating a strong, permanent seal. In addition to heat sealing, the bag's seams may first be stitched. However, stitching alone will not provide a strong enough seal.

The bag's valve 19 by which it is inflated and deflated should be of the type with a collapsible skin 30. After filling the bag through inlet 31, cap 32 is used to plug the inlet. The valve's skin 30 is then collapsed so that the cap 32 and inlet 31 do not significantly protrude from the surface of bag 28 (FIG. 4). The inventor has found that a "CARMO" valve with a 7 mm opening (model #3-612) fills these specifications. A non-return valve such as a "CARMO" model #3-664 also works well with the bag. The underside of the valve base 29 should be coated with a heat sealable material.

In use, the bag 28 is filled approximately three-quarters full with air. Underfilling the bag will allow a user to lie on the bag, and overfilling will remove the deceptive nature of the bag.

In one balance game, a user will try to lie on the bag and balance their weight thereon. It is nearly impossible to remain in a stationary position. After a short time (usually no more than a couple of seconds), the bag will shift or roll, causing the user to fall to the floor (33 and 34). The shifting is due to the cooperation of two factors: 1) the fact that the bag's material does not absorb shock, and 2) the fact that it is impossible for a user to lie perfectly still. When a user twitches a muscle at one end of the bag, the shock imparted to the bag is displaced to another portion of the user's body rather than being absorbed by the bag itself. The mere act of mounting the bag will create enough displaced shock waves to throw the beginning user. More experienced users will find that they can roll their body in a direction opposite to that of the bag's movement in an effort to stay on the bag. This unrestricted rolling movement of the bag is possible due to its center lap seam 26 construction.

In another balance game, two participants sit on opposite ends of the bag and try to throw or roll the other from the bag. The difficulty lies in the fact that any shock movement (a bounce, etc.) imparted by one user will not only be displaced to the other user, but will also return as a jolt to the original instigator.

In addition to being used as a game, the inventor can see uses for the bag in exercise. As one can imagine, the bag provides an extreme work out for a user's stomach muscles, in addition to other muscles. The bag might also be used in football blocking practice. Two opponents could grip opposite ends of the bag and impart forces to each other without diminution and without physical contact.

Although preferred embodiments of the invention have been described herein in detail, it will be understood by those skilled in the art that variations may be made thereto without departing from the spirit of the invention or the scope of the appended claims.

Having described my invention, I claim:

1. A shock displacing inflatable bag for recreational use and exercise, comprising:

a flexible rectangular sheet of material comprising first opposite edges ranging from two feet to eight feet in length, and second opposite edges ranging from four feet to eight feet in length, wherein said material is incapable of stretching or absorbing shock, wherein said first opposite edges are joined by a lap seam so as to form a cylindrical body with two ends, and wherein said ends are closed with sandwich seams; and a valve mounted over a whole in said material.

2. An inflatable bag as in claim 1, wherein:

said seams are heat sealed seams; and said valve comprises a heat sealable base and is mounted to said material by a heat seal.

3. An inflatable bag as in claim 2, wherein:

said first opposite edges are approximately seven feet in length;

and said second opposite edges are approximately six feet in length.

4. An inflatable bag as in claim 2, wherein said sheet of material comprises vinyl coated woven threads.

5. An inflatable bag as in claim 4, wherein said sheet of material is nineteen ounce, vinyl coated, 17×17 polyester scrim.

6. An inflatable bag as in claim 2, wherein said sheet of material comprises vinyl laminated woven threads.

7. An inflatable bag as in claim 2, wherein said valve further comprises:

a collapsible skin extending perpendicularly from said base;

a small inlet attached to said valve at an end opposite said base; and a capping means attached to said valve so that it may plug said inlet.

8. An inflatable bag as in claim 7, wherein said valve further comprises a non-return means wherein air may flow from the inlet through the base, but air may not flow from the base through the inlet unless the collapsible skin is squeezed so as to disengage the non-return means.

* * * * *